United States Patent [19]

Focke et al.

[11] 4,219,150

[45] Aug. 26, 1980

[54] ARRANGEMENT OF BLANKS FOR HINGED LID BOXES

[75] Inventors: Heinz Focke; Kurt Liedtke, both of Verden, Fed. Rep. of Germany

[73] Assignee: Focke & Pfuhl, Verden, Fed. Rep. of Germany

[21] Appl. No.: 932,165

[22] Filed: Aug. 9, 1978

Related U.S. Application Data

[62] Division of Ser. No. 834,945, Sep. 30, 1977, Pat. No. 4,121,756.

[30] Foreign Application Priority Data

Sep. 23, 1976 [DE] Fed. Rep. of Germany ..... 2642708
Dec. 15, 1976 [DE] Fed. Rep. of Germany ..... 2656702

[51] Int. Cl.[3] ..... B65D 5/66
[52] U.S. Cl. ..... 229/44 CB
[58] Field of Search ..... 229/41 B, 44 CB; 93/61 R

[56] References Cited

U.S. PATENT DOCUMENTS 2,163,828 6/1939 Chalmers ..... 229/44 CB
3,982,473 9/1976 Roberts ..... 93/61 R X

FOREIGN PATENT DOCUMENTS 859905 1/1961 United Kingdom ..... 229/41 B

*Primary Examiner*—Robert D. Baldwin
*Attorney, Agent, or Firm*—Sughrue, Rothwell, Mion, Zinn and Macpeak

[57] ABSTRACT

The invention relates to an arrangement of generally longitudinal blanks from which hinged lid boxes for cigarettes or the like are manufactured. The blanks are defined on an elongated web of packaging material such as cardboard or the like, and are arranged in an interconnected fashion such that very little if any of the material on the web is wasted, and waste material between adjacent blanks is eliminated.

2 Claims, 13 Drawing Figures

ARRANGEMENT OF BLANKS FOR HINGED LID BOXES

This is a division of application Ser. No. 834,945, filed Sept. 30, 1977, now U.S. Pat. No. 4,121,756 issued Oct. 24, 1978.

BACKGROUND OF THE INVENTION

The invention concerns a package with a hinged lid and consists of a collar made out of a separate blank, especially to enclose cigarettes, and of a blank with successive portions of the blank for the front wall, bottom, back wall, lid back wall, lid top surface and lid front wall, each with side flaps or side strips to form side walls and lid side walls, which are spaced along a separating line that runs from the front side to the back side of the package.

SUMMARY OF THE INVENTION

The relatively expensive construction of this type of package requires a blank that is complex and wasteful of material. The purpose of the invention, therefore, is to so arrange the blank for the production of this type of box having a lid, that first, the blank itself requires less packaging material, and second, an additional saving of material is achieved in that within one web of the packaging material the neighboring blanks require less material because of an alternating tooth-like engagement.

To accomplish this purpose, the package according to the invention is characterized in that the outer side flaps of side flaps of the lid that border the front wall, lid front wall and lid top surface are provided with dimensions that correspond with the dimensions of the side walls or lid side walls of the package, and the inner side strips or inner lid side strips that border the back wall, the bottom, and the lid back wall have a smaller width than the side walls or lid side walls.

The novelty of the invention is accordingly found in that chosen areas of the blank are formed with decreased dimensions. These areas of the blank lie exclusively on the inside of the package. The result of this is that the outer appearance is indistinguishable from previous models.

The blank for the production of this type of package is obtained according to the invention in various manners. Accordingly, it is possible to obtain the blank directly and in one piece by a relative arrangement on a surface of the packaging material by cutting it, for example, by punching or from a continuous strip of the packaging material. But it is also possible to obtain, also by stamping, a special preform of a blank. From this preform a part is then separated and placed in a different location to form the blank according to the invention.

DETAILED DESCRIPTION OF THE PREFERRED EMBODIMENTS

Figure 1:
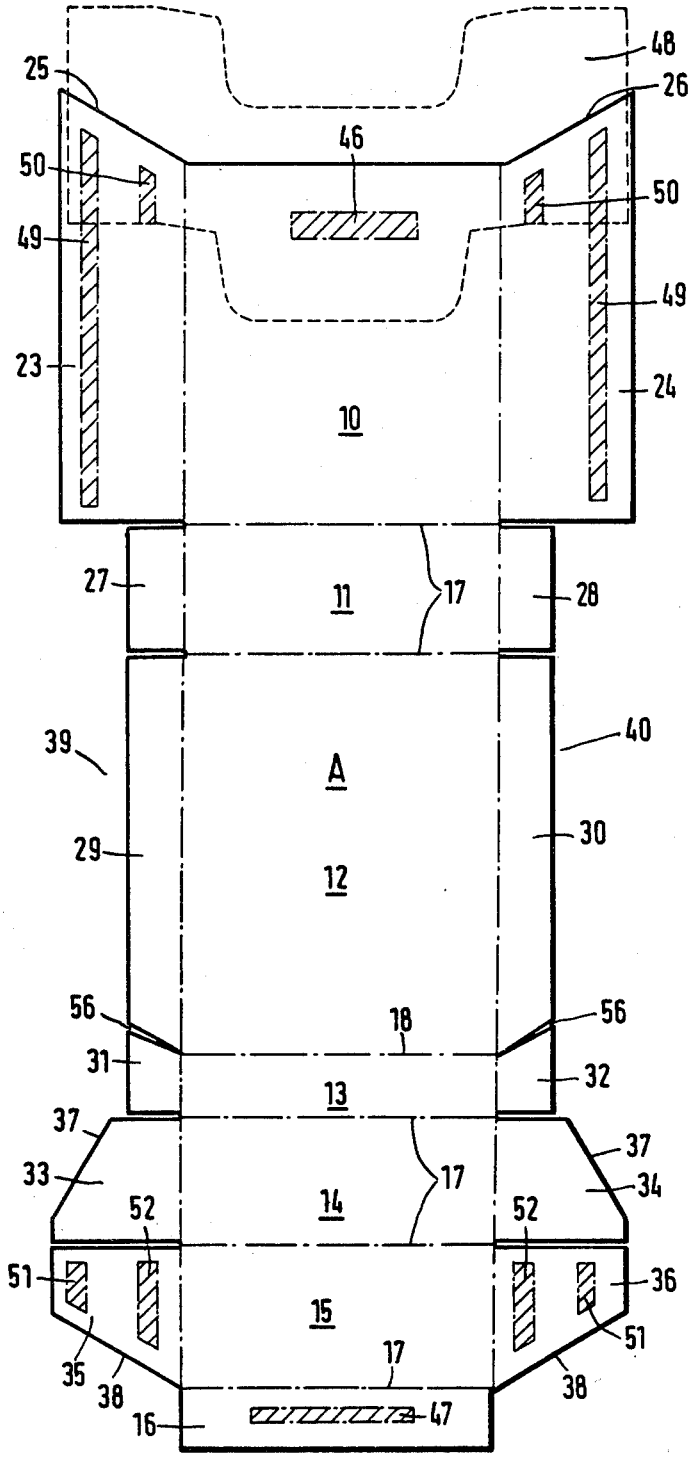
FIG. 1 shows an exemplary embodiment of a spread out blank.
Figure 2:
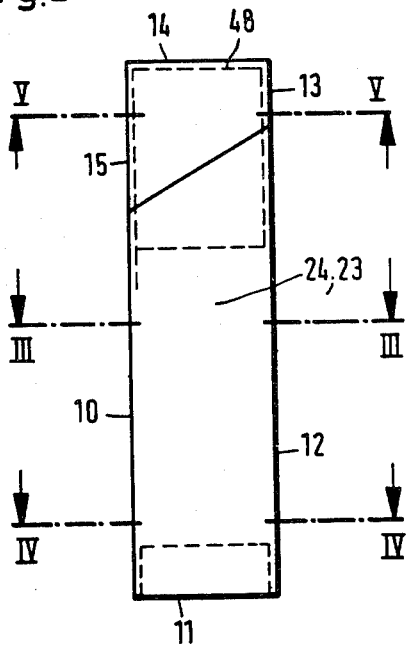
FIG. 2 shows a simplified side view of a package with a lid formed from the blank according to FIG. 1.
Figure 3:
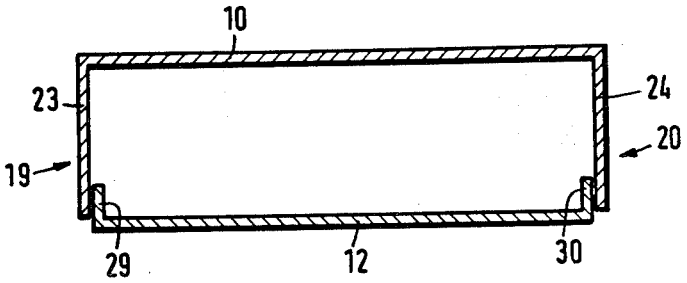
FIG. 3 shows a horizontal section through the covered pack according to FIG. 2 along the line III—III.
Figure 4:
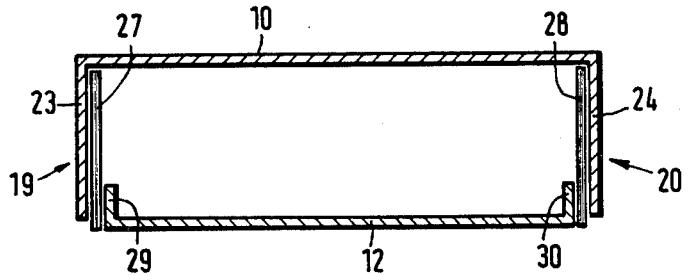
FIG. 4 shows a horizontal section along the line IV—IV of FIG. 2.
Figure 11:
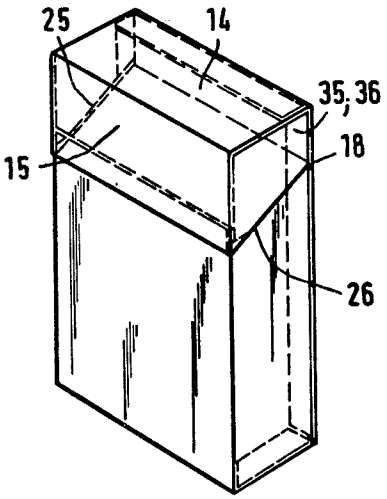
FIG. 11 shows a completely folded, closed package with a lid in perspective illustration.

The blank shown in FIG. 1 serves to produce a hinged lid package as shown in a simplified side view in FIG. 2 and in perspective in FIG. 11. The blank consists principally of a one-piece main portion A with folding flaps arranged on the sides thereof. The one-piece main portion of the blank consists of surface areas for the formation of a front wall 10, a bottom 11 and a back wall 12 of the actual box. Furthermore, surface areas are connected to the back wall 12 and thus belong to the blank main portion A that form the cover or lid, namely a lid back wall 13, a lid top surface 14 and a lid front wall 15. The surface defining the cover front wall 15 is provided along its free edge with an inner lid flap 16 formed as a narrow strip. The previously mentioned surface areas of the blank border each other across lateral folding lines 17. The cross-over between the back wall 12 of the box and the back wall of the cover 13 forms a lateral hinged axis 18. The lid for the box can be rotated in a known manner relative to the box around this axis 18.

On most of the areas of the blank being described, additional surface areas, namely folding flaps, are joined onto the sides to form side walls 19 and 20 of the package as well as lid side walls 21 and 22.

In the area of the front wall 10, side flaps 23 and 24 are arranged which in the folded package lie on the outside, covering the full surface or width of the side walls 19 and 20. The free narrow edges of these side flaps 23, 24 are provided with angled corners 25 or 26, that extend in a known manner into the area of the side walls 19 and 20 along the correspondingly angled corners of the lid.

Corner flaps 27 and 28 are arranged at the sides of the bottom portion 11, but are not directly connected to the side flaps 23 and 24. The same is true of the side flaps 29, 30 that are joined to the sides of the back wall 12 running in the same direction as the length of the blank. These flaps 29, 30 lie on the inside of the finished package and are connected with the outer side flaps 23, 24 or the corner flaps 27, 28.

The back wall 13 of the lid is provided on the sides with center flaps 31 and 32, which are separated from the inner side flaps 29 and 30 by angular cuts 56.

The top surface 14 and the front wall 15 of the lid have side flaps 33 and 34, 35 and 36, which partially extend about as far as the width of the outer side flaps 23 and 24. The side flaps 35 and 36 of the lid, that are arranged in the present example on the front wall 15 of the lid, lie on the outside of the side walls 21, 22 of the lid. The dimensions and configuration of these lid side flaps 35, 36 is such that the trapezoidal outer surfaces of the lid side walls 21, 22 are completely covered. In the embodiments according to FIGS. 1, 7, 8 and 10 the inner lid side flaps 33 and 34 also have dimensions such that the inner side of the lid side walls 21, 22 are completely covered. Because the lid has angled edges on its sides that match the bordering angled edges of the box sides, the lid side flaps 33, 34 or 35, 36 are accordingly provided with angled, aligned edges 37 or 38.

The blank thus constructed forms somewhat eccentrically-lying side recesses 39 and 40 because of smaller cross measurements.

Because of this contour of the blank, it is possible to place them in an inverted staggered manner on a continuous strip of packaging material, nested in or mating with each other, thereby saving material.

Figure 8:
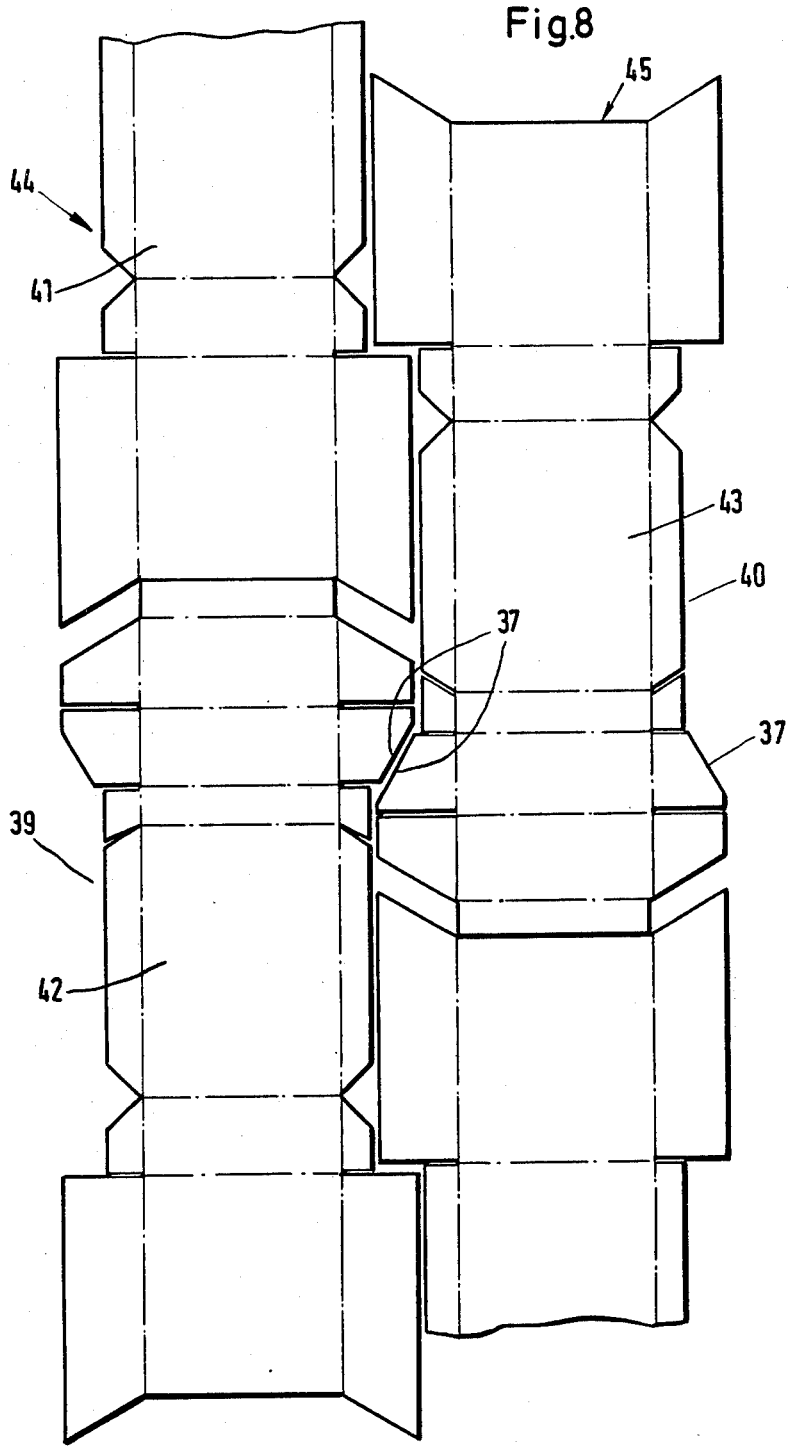
FIG. 8 shows a partial view of a strip made of the packaging material with blanks according to FIG. 7.

A segment of such a packaging strip is illustrated in FIG. 8. Accordingly, the blanks 41, 42, 43 are arranged in blank rows 44, 45, each running in the direction of the length of the strip. The blanks 41, 42 of a blank strip 44 are arranged in the longitudinal direction of the length of the strip and are staggered relative to the blanks 43 of the neighboring blank strip 45. For reasons of illustrative clarity, spaces are shown between the blanks of the strips 44, 45, which are not present between the actual strips.

Both the lid side flaps 33 and 35 or 34 and 36 of a blank 42 and the outer, wide side flaps 23 or 24 of an additional blank 41 in the same blank strip 44 extend into the recess 39 or 40 of a blank 43 in such a manner that the blanks form fit against each other. When so positioned, the angled edges 37 of the blanks 42 and 43 of neighboring strips abut each other. The wide side flaps 23 or 24 of the staggered blanks 41 and 43 lie longitudinally opposite each other with the angled end edges.

Figure 9:
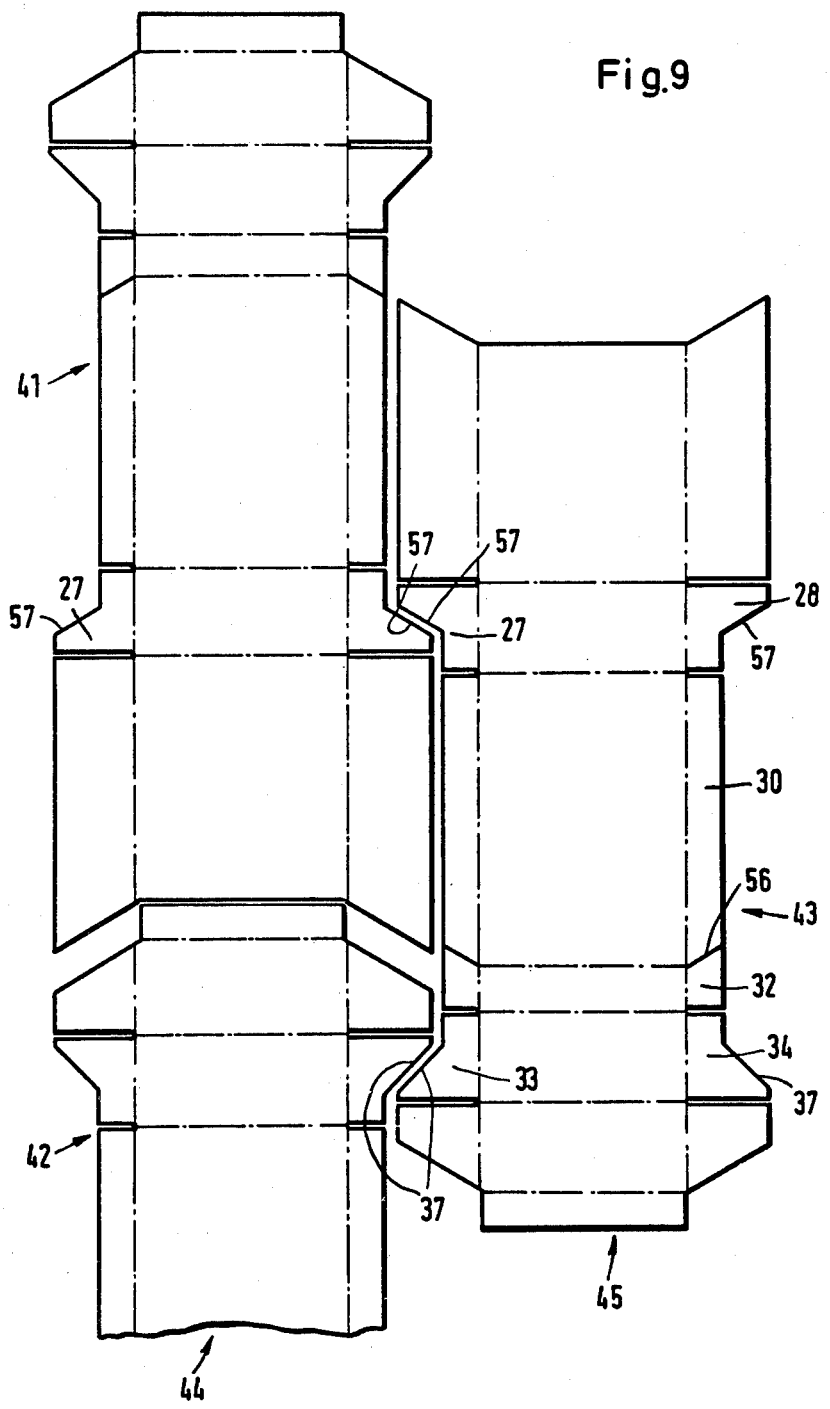
FIG. 9 shows a partial view of a strip in an illustration similar to FIG. 8 with a further embodiment of the blanks.

An alternate embodiment of a blank that is similar in principle to the one already described can be seen in FIG. 9. The recesses 39 and 40 extend here partially into the area of the inner side flaps 33 and 34 of the lid on one side and of the corner flaps 27 and 28 on the other side.

The previously mentioned portions of the blank are accordingly formed in one area in the width of the narrow side flaps 29 and 30, and in one area in the full width of the side flaps 23 and 24. Between these areas of the mentioned folding flaps angled transition edges 57 (with the corner flaps) and angled edges 37 are formed. The previously mentioned angled edges 37 and 57 of neighboring or successive blanks thereby abut each other.

Figure 10:
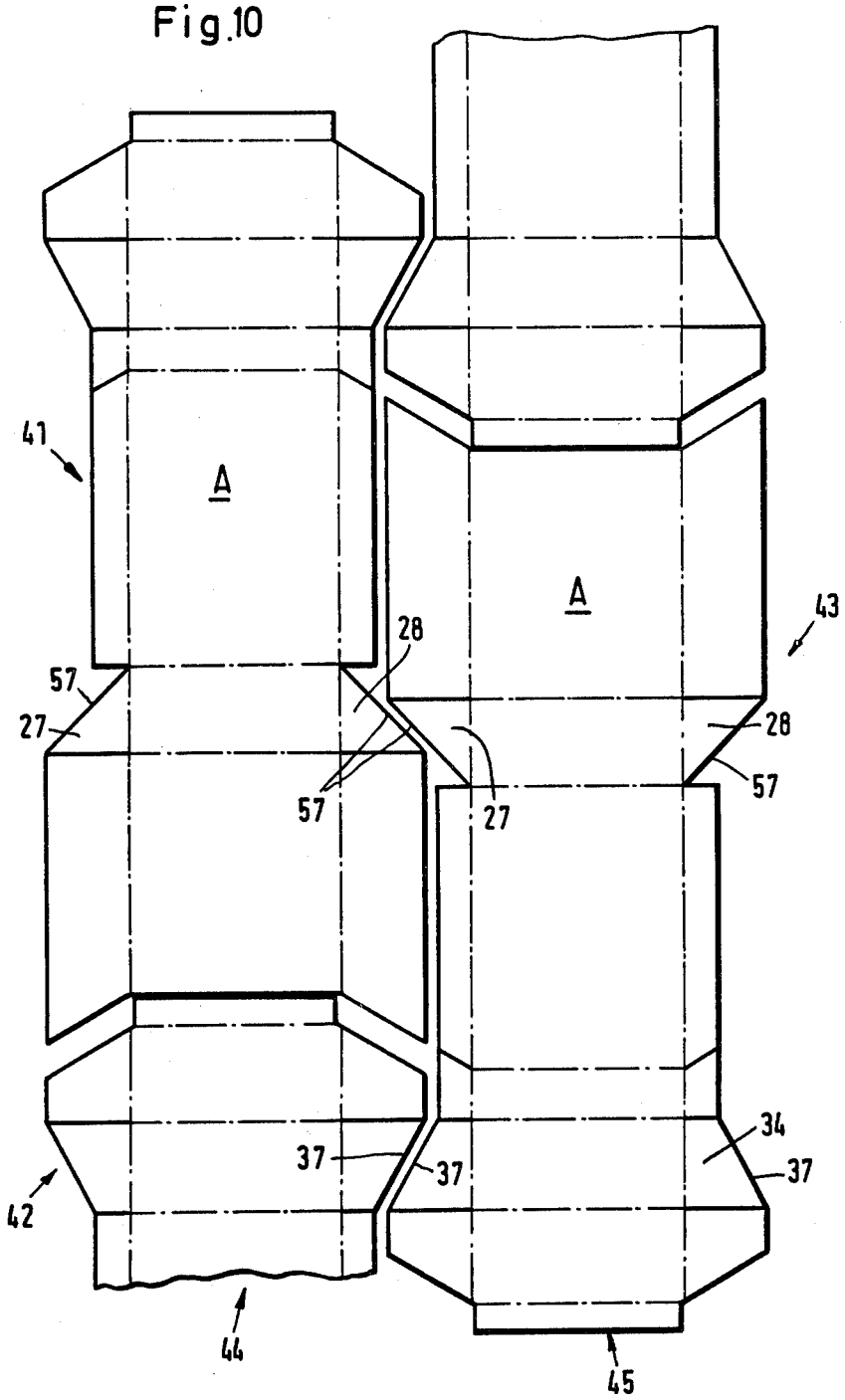
FIG. 10 shows a partial view of a strip according to a further blank embodiment.

A further embodiment of a blank can be seen in FIG. 10. The corner flaps 27 and 28 are here formed as triangular folding flaps. The thus produced outer angled transition edges 57 extend from the outer point, where it extends to the width of the side falps 23, 24 to the border of the main portion A of the blank. Here, too, edges 37 of two blanks and edges 57 of two blanks abut one another.

Details of a flip top box produced from a blank according to FIG. 1 are seen in FIGS. 2 through 6.

In the area of the bottom 11, the portions of the blank are folded (FIG. 4) so that the corner flaps 27 and 28 extend between the narrow inner side flaps 29, 30 on one side and between the outer side flaps 23 or 24. The folding, for example, with the use of a device according to German Offenlegungsschrift No. 2,440,006 progresses in such a manner that first the side flaps 29 and 30 are folded, then the corner flaps 27 and 28, and finally the side flaps 23 and 24.

Figure 5:
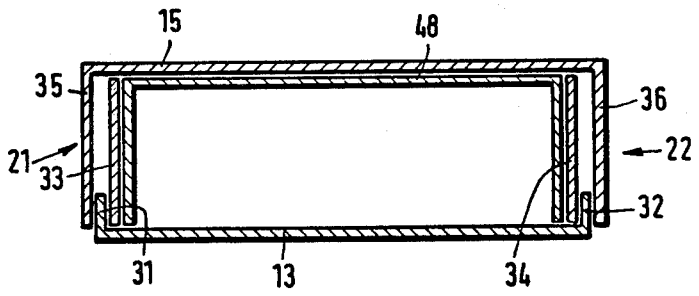
FIG. 5 shows a corresponding cross section along the line V—V of FIG. 2.
Figure 6:
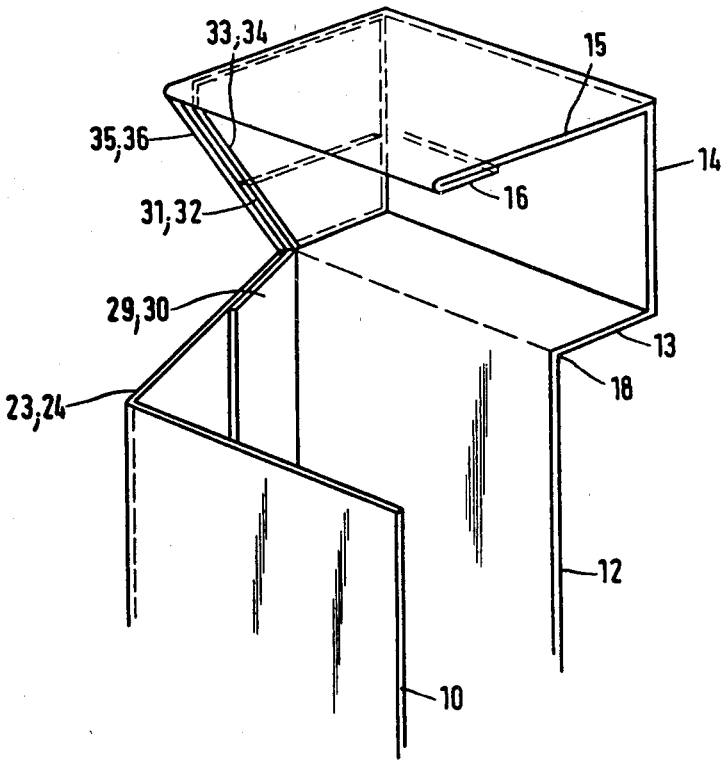
FIG. 6 shows a perspective view of the lid section of the package with a lid as seen when open.

The lid is constructed in a special manner. As can be seen in FIGS. 5 and 6, the lid side flaps 35 and 36 that join the lid front wall 15, lie on the outside of the lid side walls 21 and 22. Their trapezoidal surface is completely covered by the previously mentioned lid side flaps 35 and 36. Similarly, the inside side flaps 33 and 34 of the lid top surface 14 are arranged to cover the full surface of the side walls 21, 22 of the lid. In between extend the center flaps 31 or 32, whose angled edges are flush with the corresponding edges of the lid.

The blank is provided in a special manner with gummed areas 46 or 47 as well as gummed strips 49, 50, 51, 52. These single gummed areas 46, 47 are not preapplied on the spread out blank, for example in the blank magazine, but rather they are applied in the packaging machine after the packaging process has advanced somewhat, so that freshly applied gummed areas 46, 47 free from dirt, etc., can always be worked with.

First, gummed areas 46, 47 are applied, of which the first serves to attach a collar 48 on the inside of the front wall 10. By means of the gummed area 47, the inner flap 16 of the lid is connected with the front wall 15 of the lid.

The gummed strips 49 and 50, i.e. 51 and 52 are then applied in the area of the outer side flaps 23 and 24, as well as on the outer side flaps 35, 36 of the lid. The relatively short gummed strip 50 serves to fix the collar 48 on the inner side of the side flap 23, i.e. 24, which is exposed in this area. The connection with the side flaps 29 and 30 is produced by the gummed strip 49 that extends roughly over the full height of the side flaps 23, 24.

The three layer connection in the area of the lid side walls 21, 22 is produced by the gummed strips 51 and 52. The gummed strip 51 connects the outer side flaps 35, i.e. 36 of the lid with the coerner flap 31, i.e. 32, while the gummed strip 52 glues the outer side flaps 35, 36 of the lid to the inner side flaps 33, i.e. 34 of the lid. In this manner a statically stable and sturdy construction is formed.

Figure 7:
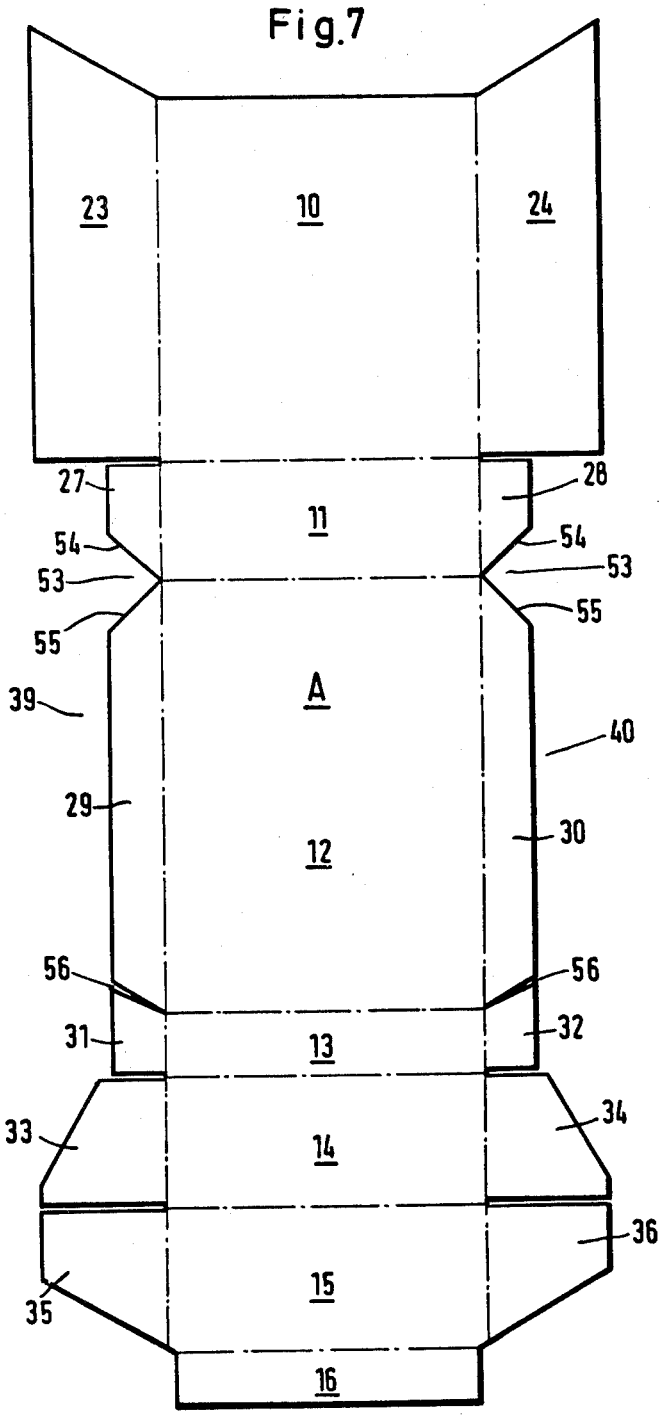
FIG. 7 shows an additional embodiment of a blank in an illustration similar to FIG. 1.

The blank according to FIG. 7 is modified in the area of the bottom 11 as compared to that in FIG. 1. The areas of the corner flaps 27 and 28 that are directed towards each other and the side flaps 29 and 30 are provided with a triangular cut 53. The previously mentioned portions of the blank are accordingly blocked by the angled edges 54 and 55. This construction causes in the folded box, that the corner flaps 27, i.e. 28 and the associated side flaps 29 and 30 lie at a level, whereby the edges 54 and 55 abut one another. The concerned portions of the blank thus abut as if mitered.

Figure 12:
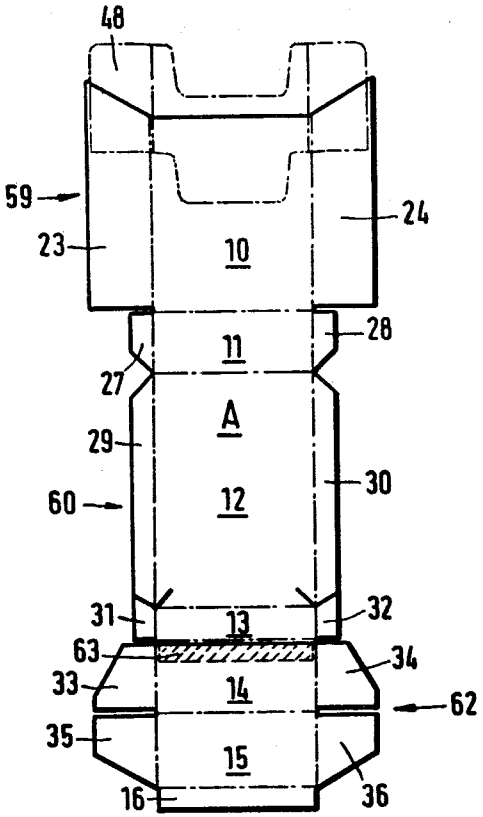
FIG. 12 shows a blank according to the invention produced by another method.
Figure 13:
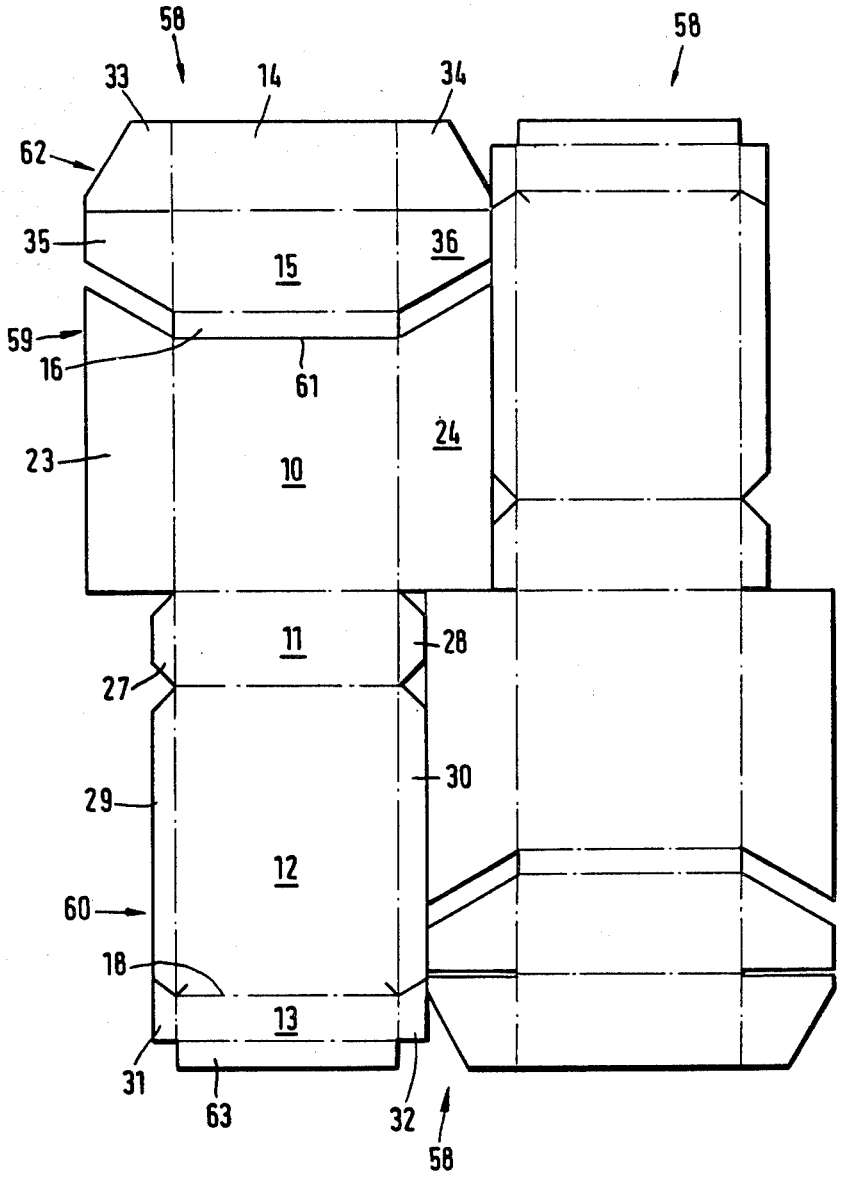
FIG. 13 shows a nested preforms as intermediate products for the production of a blank according to FIG. 12.

The blank shown in FIG. 12 corresponds to that in FIG. 7, but is produced by a different process. Here, preforms 58 are first produced as an intermediate product (FIG. 13), namely by separation from a strip of the packaging material. The preforms 58 are formed so that an exclusive wide portion 59 of the blank and an extremely narrow portion 60 of the blank, each having the same length, join together. In this manner it is possible by turning the preform 58 by 180° to box them together with practically no failures.

A piece 62 (consisting of the lid top surface 14, lid front wall 15, and lid inner flaps 16 with the connected side flaps) is then separated from this preform 58 along a separating line 61, and placed at a different position, namely above a connecting flap 63 on the lid back wall 13. The foldable blank according to FIG. 12 is produced in this manner.

What is claimed is:

1. An arrangement of generally longitudinal blanks from which hinged lid boxes for cigarettes or the like are folded, such blanks being defined on an elongated web of packaging material such as cardboard or the like, characterized by:

(a) each individual blank comprising successive portions for a front wall (10), bottom (11), rear wall (12), lid rear wall (13), lid ceiling wall (14), and lid front wall (15), each having side flaps for forming side walls (19, 20) and lid side walls (21, 22), (b) said side flaps associated with said front wall (23, 24), said lid ceiling wall (33, 34), and said lid front wall (35, 36) being formed with dimensions corresponding to the dimensions of said side walls (19, 20) and said lid side walls (21, 22), so as to form first, second, and third wider portions, respectively, (c) said side flaps associated with said bottom (27, 28), said rear wall (29, 30), and said lid rear wall (31, 32) being formed with dimensions substantially smaller than that of said side walls (19, 20) and said lid side walls (21, 22), so as to form a recessed portion, (d) said blanks being arranged such that said second and third wider portions of a first blank (42) and said first wider portion of a second blank (41) project into said recessed portion of a third blank (43), (e) at least said second wider portion of the first blank (42) and the adjacent second wider portion of the third blank (43) being provided with oblique edges (37) which run adjacent to one another.

2. An arrangement of blanks as recited in claim 1, wherein said flaps associated with said bottom portion (27, 28) are formed with oblique transition edges (57) such that the transition edges (57) of the second blank (41) are complementary to the transition edges (57) of the third blank (43).

* * * * *